US005755274A

United States Patent [19]

Maiwald et al.

[11] Patent Number: 5,755,274

[45] Date of Patent: May 26, 1998

[54] STRIP CASTING PLANT FOR METALS

[75] Inventors: Klaus Peter Maiwald, Thun; Michel Meyer, Estavayer-le-Lac, both of Switzerland

[73] Assignee: Pechiney Rhenalu, Courbevoie, France

[21] Appl. No.: 245,424

[22] Filed: May 18, 1994

[30] Foreign Application Priority Data

May 18, 1993 [CH] Switzerland ..... 01506/93

[51] Int. Cl.[6] ..... B22D 11/06; B22D 11/10; B22D 41/50

[52] U.S. Cl. ..... 164/479; 164/428; 164/438; 164/480; 164/481; 164/483; 164/489

[58] Field of Search ..... 164/488, 489, 164/490, 479, 480, 481, 428, 438, 439, 483; 222/591, 594

[56] References Cited

U.S. PATENT DOCUMENTS

| | | | |
|---|---|---|---|
| 2,752,649 | 7/1956 | Hunter . | |
| 3,774,670 | 11/1973 | Gyöngyös . | |
| 4,544,018 | 10/1985 | Figge et al. | 164/481 |
| 4,602,668 | 7/1986 | Bolliger | 164/452 |
| 4,641,767 | 2/1987 | Smith | 164/428 X |
| 4,648,438 | 3/1987 | Hazelett et al. | 164/481 X |
| 4,821,790 | 4/1989 | Tsuchida et al. | 164/430 |
| 4,926,925 | 5/1990 | Takahashi et al. | 164/154 |
| 4,972,900 | 11/1990 | Szcypiorski | 164/488 X |
| 5,176,198 | 1/1993 | Frischknecht et al. | 164/480 |
| 5,303,765 | 4/1994 | Pearson et al. | 164/480 X |

FOREIGN PATENT DOCUMENTS

| | | | |
|---|---|---|---|
| 0137238 | 4/1985 | European Pat. Off. . | |
| 0149164 | 7/1985 | European Pat. Off. | 222/591 |
| 61-229449 | 10/1986 | Japan | 164/438 |
| 62-192229 | 8/1987 | Japan | 164/480 |

OTHER PUBLICATIONS

Abstract of Japanese Patent Publication 1-224144 Published Sep. 7, 1989.

*Primary Examiner*—J. Reed Batten, Jr.
*Attorney, Agent, or Firm*—Sheridan Ross P.C.

[57] ABSTRACT

The strip casting plant has a casting nozzle (10) displaceable in the direction of flow (F) of the liquid metal and adjustable perpendicular to this, to supply liquid metal to the adjustable roller gap (30) between rotating dies (26, 28). The casting nozzle (10) consists of an upper and a lower nozzle element (14, 16) and in vertical strip casting plants a left and a right nozzle element (14, 16) mounted on a melt distribution trough, and two side limiters which form a slot-like outlet opening (20) for the liquid metal. One or both of the nozzle elements (14, 16) is adjustable at least in the area of the outlet opening (20). On operation of the strip casting plant, the casting nozzle (10) is advanced at the start with outlet opening (20) in start position (S) and then withdrawn to work position (W), where the outlet opening (20) is expanded under adaptation to the casting rollers (26, 28).

37 Claims, 5 Drawing Sheets

STRIP CASTING PLANT FOR METALS

FIELD OF THE INVENTION

The invention relates to a strip casting plant for metals, in particular for aluminium and aluminium alloys, with a casting nozzle displaceable in the direction of flow of the liquid metal and adjustable perpendicular to this, to supply liquid metal to the adjustable rolling gap between rotating dies, where the casting nozzle consists of two nozzle elements attached to a melt distribution trough and two side limiters which form a slot-like outlet opening for the liquid metal. In horizontal or inclined strip casting plants, the casting nozzle has one upper and one lower nozzle element, and in vertical strip casting plants, one left and one right nozzle element. The invention also relates to a process for operation of the strip casting plant.

BACKGROUND OF THE INVENTION

The description which follows describes in particular horizontal strip casting plants. However these can also be inclined upwards e.g. at 15° or inclined downwards and the invention still applies. The invention can also be applied to vertical strip casting, where merely a few terminology changes evident to the expert are required which are usually omitted here and in the description which follows for the sake of clarity.

Known strip casting plants have, in a first variant, two casting rollers arranged above each other (eg. Lauener Rollcaster), and in a second variant two casting belts which run above each other (eg. Hazelett) or crawler dies (eg. Lauener block caster), which are held by a machine frame or arranged in a housing. In the following description, all types of dies forming the casting gap in accordance with the preferred design form of the invention are referred to as casting rollers. However this term also covers endless casting belts or crawler dies in strip casting devices.

In the area of the rolling or casting gap, in the working position between the two casting rollers is a nozzle which is usually attached to the machine frame. A casting trough supplied by a casting channel system, referred to by the expert as a melt distribution trough, transfers fluid metal to the nozzle, the liquid metal sets between the casting rollers and emerges as a partially rolled strip. This casting nozzle can be removed with its nozzle holder but access is severely restricted in particular due to the machine frame or housing.

Today the strip casting process is used for casting strips down to a thickness of approximately 2 mm, in particular 3 to 7 mm, which imposes very high requirements on the nozzle itself and its positioning.

The nozzle must not only resist erosion or dissolution in aggressive liquid metal, but also it must not have a high thermal conductivity else the liquid metal could set in the nozzle, and it must also resist the rough casting operation.

In U.S. Pat. No. 2,752,649 by Hunter, assigned to Hunter Douglas Corporation, for example, a suitable material for a casting nozzle has been known for some time. This must be positioned so precisely that firstly no accidentally touching parts damage the roller surface and also the spaces between the nozzle and the casting roller must not be so large that the liquid metal can escape from between the nozzle and the surface of the casting roller. For casting of aluminium for example a distance between the nozzle and the casting roller of 0.2 mm is regarded as optimum, above 0.5 mm the escape of metal melt can scarcely be prevented.

U.S. Pat. No. 5,176,198 by Frischknecht et al., assigned to Lauener Engineering Limited, describes a horizontally displaceable and height-adjustable casting nozzle for the supply of liquid metal to a roller gap where the supply of metal need not be interrupted during positioning of a nozzle. This allows the casting nozzle to be changed without interrupting operation.

European Patent No. 0137238, assigned to Norsk Hydro A/S, discloses a casting system for continuous strip casting of metals and, more particularly, a nozzle package comprising an extruded nozzle holder and a refractory precast nozzle. The nozzle holder is extruded as one piece with all essential and functional details and tolerances. The nozzle holder and a complementary fastening wedge are both extruded in hardened aluminum alloy. Screws are applied in the nozzle holder to clamp the casting nozzle in it by means of the said fastening wedge.

Japanese Patent No. 1-224144, assigned to Ishikawajima-Harima Jukogyo K. K., discloses how to make slowly and uniformly pouring molten steel flow and to produce a good cast slab by once receiving the molten steel into a shelf-like manifold arranged in the fixed core and flowing out into a nozzle. A molten steel float down from a tundish is once received into the shelf-like manifold arranged in the fixed core. After reducing the flowing speed, the molten steel is flowed out to the slit nozzle. An actuator is worked and a shifting core is shifted to approaching or separating direction to the fixed core. The interval between the mutual cores 12,14, the flow rate of molten metal is adjusted. Screws are applied to clamp the casting nozzle in the holder by means of a complementarily designed fastening wedge.

SUMMARY OF THE INVENTION

The inventors have faced the task of creating a strip casting plant for metals of the type described initially and a process for its operation which allows a casting nozzle with permanent optimum positioning.

Calculations with computer models and experiments have shown that productivity can be increased if the distance of the nozzle to the roller gap is increased. This distance must not however be too large when starting the strip casting plant else this will be overloaded due to the material setting too early or it must be designed for the use of greater forces. In most plants, the casting nozzle can either not be adjusted or only adjusted to a limited extent during operation under difficult and awkward conditions. For example, a horizontally displaceable and height-adjustable casting nozzle in accordance with the said U.S. Pat. No. 5,176,198 by Frischknecht et al. is of assistance. On each withdrawal of the nozzle from the optimum position, a gap occurs in known plants through which metal can flow after exceeding the surface tension.

The task in relation to the strip casting plant is solved by the invention in that one or both of the nozzle elements is adjustable at least in the area of the outlet opening.

Adjustable nozzle elements ensure that on withdrawal of the casting nozzle the gap between the nozzle lip and the roller can be held constant and no metal can flow back.

The two side limiters of the casting nozzle are designed in themselves such that the outlet opening of the nozzle can expand on withdrawal without metal flowing out between a nozzle element and a side limiter.

The following variants for example apply to the adjustment of the outlet opening:

One of the two nozzle elements is rigidly attached to the melt distribution trough, the other can be parallel-displaced.

Both nozzle elements can be displaced parallel on the melt distribution trough.

One nozzle element is rigidly attached to the melt distribution trough, the other has an articulated connection.

Both nozzle elements have an articulated connection to the melt distribution trough.

Both nozzle elements are rigidly mounted on the melt distribution trough and in the direction of the outlet opening have a hinge running parallel to this.

Both nozzle elements are rigidly mounted on the melt distribution trough, one nozzle element has in the direction of the outlet opening a hinge running parallel to this.

Evidently, in all variants, an adjustable nozzle element refers to either the upper or the lower, and in vertical strip casting plants either the left or the right element. There are also other possible combinations, for example a parallel displaceable nozzle element with a joint in the direction of the outlet opening. These combinations are restricted by technical problems and considerations of economics, according to which the simplest and most stable variant is always the best.

A joint arranged directly on the melt distribution trough is preferably a hinge which swivels about an axis. A joint on a nozzle element is suitably a hinge which swivels about an axis, a strip hinge, in the casting of aluminium in particular made of spring steel, a moulded elastic block, in particular of the same fibre material as the nozzle element, or a tension resistant textile.

The nozzle elements may be designed in conventional manner, essentially in the form of a pen when viewed from the side. At least one nozzle element is separated at a suitable point to form a joint and connected articulatedly with the remaining piece rigidly attached to the melt distribution trough.

The invention can also be used to simplify the design of the casting nozzles. A plate-like piece is rigidly connected with the melt distribution trough and in the direction of the outlet opening has a hinged connection to an essentially thinner plate which can be rectangular in cross section, but also rhomboid or even triangular.

As already stated, the very short distance of approx. 0.2 to 0.5 mm between a nozzle lip and the corresponding roller must be kept constant so that no scrape marks are made on the casting roller and the metal cannot flow back between the casting nozzle and the roller.

In one variation of the invention, in the area of the nozzle lips are mounted in the nozzle elements slide inserts of a self-lubricating material, in particular graphite or hexagonal boron nitride. Thus the nozzle elements can rest on exposed areas or arranged at regular intervals over the entire width without causing scrape marks. See U.S. Pat. No. 3,774,670 by Gyongyos, assigned to Lauener Engineering Limited for further details. The slide insert can extend over the entire nozzle width.

With reference to the process for operation of a strip casting plant, the task is solved by the invention in that the casting nozzle is advanced at the start with the outlet opening in a start position and is then withdrawn to a working position where the outlet opening is expanded with adaptation to the rotating dies.

When the casting nozzle is withdrawn, the constantly present although low metallostatic pressure acts in the direction of expansion of the outlet opening. Preferably during withdrawal of a horizontal or inclined casting nozzle, the metallostatic pressure is increased in particular by a level increase in the melt distribution trough. This guarantees that the moving part of the nozzle elements is spread or displaced parallel until the original distance from the casting roller is restored.

The swivel movement or parallel displacement of at least one nozzle element can take place with the assistance or at least co-operation of mechanically exerted force. For example, the thrust can be generated by spring force, by a counterweight, by pneumatic, hydraulic or electrically generated force.

As initially indicated, the casting nozzles according to the invention can be used in all types of strip casting plants, for example roller casting plants, casting plants with endless conveyors or crawler die conveyors.

This strip casting plant can be used for casting not only aluminium and aluminium alloys, but also other metals such as zinc, lead, copper, iron and their alloys including steel.

The cast metal strip always has a surface free of level lines, i.e. with no transverse grooves.

For the production of the nozzle elements, ceramic fibres are preferably used which are impregnated with slip, dried and baked. This gives a relatively brittle moulded body which is fire-resistant, chemically and physically resistant to the liquid metal and has a low thermal conductivity.

BRIEF DESCRIPTION OF THE DRAWINGS

The invention is described in more detail using the design examples shown in the drawing. The diagrams show.

DETAILED DESCRIPTION OF THE PREFERRED EMBODIMENT

Figure 1:
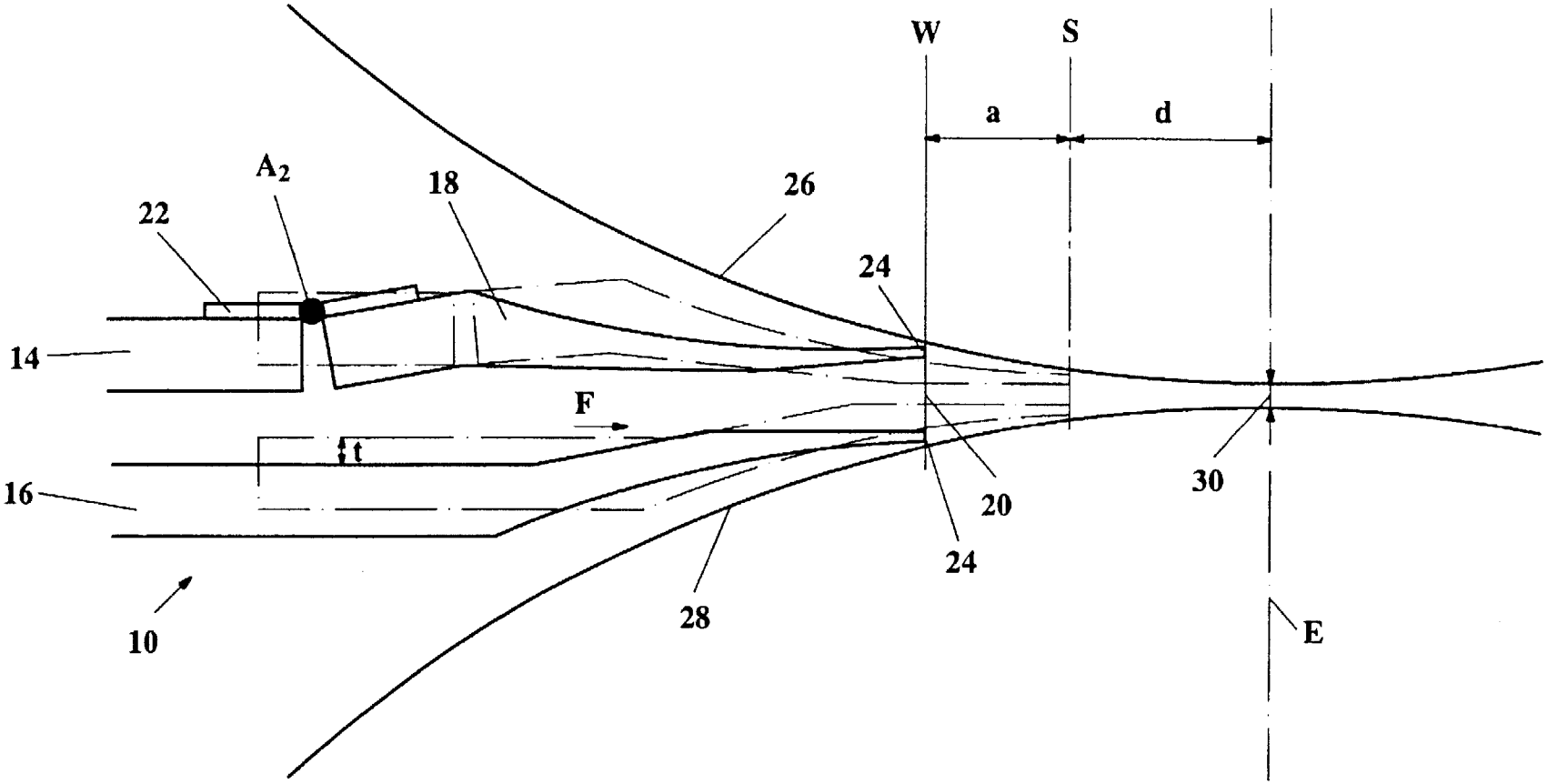
FIG. 1 a longitudinal section through a casting nozzle introduced between rotating casting rollers with an adjustable nozzle element, FIG. 2 a variant of FIG. 1 with two adjustable nozzle elements, FIG. 3 a longitudinal section through a melt distribution trough with attached casting nozzle, FIG. 4 a partial longitudinal section through a casting nozzle with a moulded joint, FIG. 5 a partial longitudinal section through a casting nozzle with a textile hinge, FIG. 6 a longitudinal section through the area of a nozzle lip with self-lubricating insert, FIG. 7 an upper nozzle element with strip hinge and a spring, and FIG. 8 a upper nozzle element with a strip hinge and counterweight.

The casting nozzle 10 shown in FIG. 1, which is mounted on a melt distribution trough 12 (see FIG. 3), comprises an upper and a lower nozzle element 14, 16. The upper nozzle element 14 has an adjustable mouthpiece 18 and can swivel around an axis $A_2$ of a hinge 22 which swivels parallel to outlet opening 20 of casting nozzle 10.

On start up, the casting nozzle 10 with outlet opening 20 is advanced into the start position S shown in dotted lines. The distance of the nozzle lips 24 from the upper and lower casting rollers 26, 28 lies in the range of 0.2 to 0.3 mm. Distance d of nozzle opening 20 from the roller gap 30, the minimum distance of casting rollers 26, 28 at connection plane E from their axes lying outside the drawing sheet, is in the range of 20 to 50 mm.

Immediately after start up, the casting nozzle 10 is withdrawn by the distance a of approximately 30 to 70 mm into working position W of the outlet opening 20. On withdrawal, the casting nozzle 10, also program-controlled, is lowered by depth t which is calculated as a function of the roller radius not shown and distances a, d such that the distance between the nozzle lip 24 of the lower nozzle element 16 from the lower nozzle roller 28 remains unchanged at approximately 0.2 to 0.5 mm.

The mouthpiece 18 of the upper nozzle element is adjusted with the means shown in detail in the following drawings such that the distance of the nozzle lip 24 from the upper nozzle element 14 remains constant.

Casting nozzle 10 thus automatically adapts to the roller on withdrawal and allows a relatively great adjustment facility. Distance d is set as low as the nozzle construction allows, and distance a sufficiently large for the machine not to be overloaded or require larger dimensioning.

Figure 2:
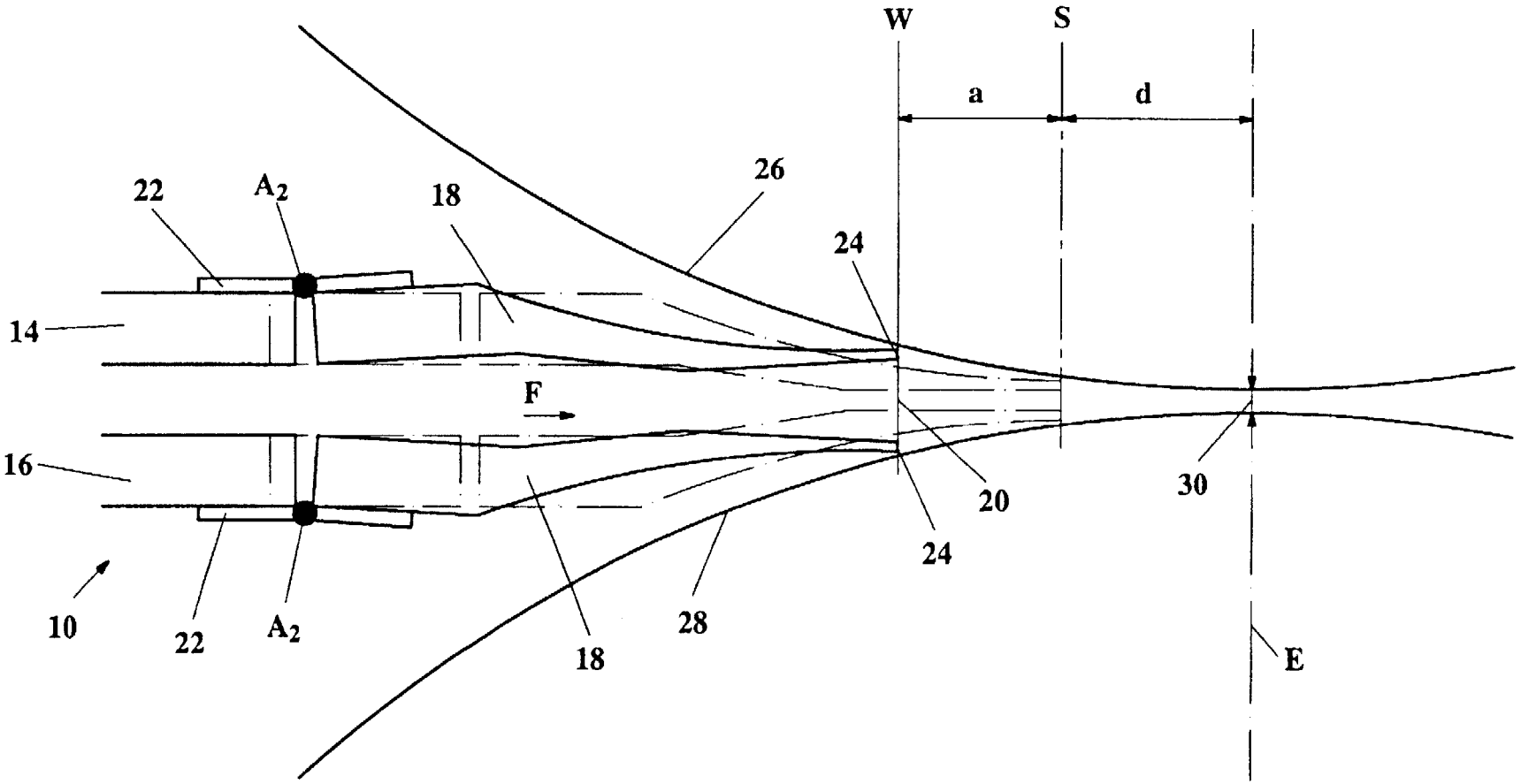

In FIG. 2, a variant of FIG. 1, the lower nozzle element 16 also has a mouthpiece 18 rotatable about a hinge 22 with axis $A_2$. On withdrawal of the casting nozzle 10 from the starting position S to the working position W by distance a, its height is not adjusted and the lowering t in FIG. 1 is omitted. Both mouthpieces 18 are adjusted by means shown later in detail by swivelling about respective axis $A_2$ such that the distance of the nozzle lips 24 from the casting rollers 26, 28 remains unchanged at approximately 0.2 to 0.3 mm.

Figure 3:
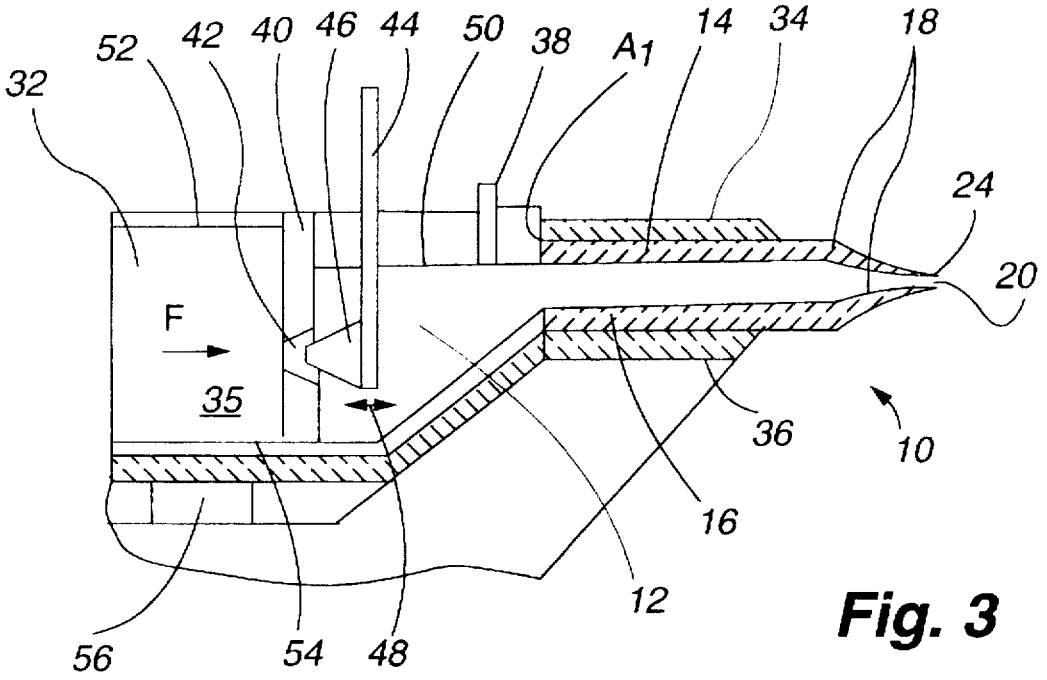

FIG. 3 shows a movable casting channel 32 in accordance with U.S. Pat. No. 5,176,198 by Frischknecht et al., which in relation to the direction of flow F of the liquid metal 35, in the present case an aluminium alloy, has a melt distribution trough 12 with a removably attached casting nozzle 10. The upper nozzle element 14 is mounted about a hinge 22 with an axis $A_1$, the lower nozzle element 16 is rigid on the melt distribution trough 12. Both nozzle elements 14, 16 are supported by a swivelling or rigid nozzle holder 34, 36 which can be removed with the casting nozzle 10 with a lowerable slider 38 to close the melt distribution trough 12.

The melt distribution trough 12 is separated from the movable casting channel 32 by a partition wall 40 with opening 42. This opening 42 is programmably closeable by means of a flap 44 with an upstanding truncated cone-shaped peg 46. The swivel movement of the flap 44 is indicated by an arrow 48. The metal level 50 in the melt distribution trough 12 can be adjusted by the insertion depth of the peg 46 in opening 40, but in any case is below the metal level 52 in the movable casting channel 32.

Both the movable casting channel 32 and the melt distribution trough 12 are line d with a refractory insulation layer 54. 56 indicates an outlet for the liquid metal 35.

For the height adjustment, advance and withdrawal of the casting nozzle 10, express reference is made to U.S. Pat. No. 5,176,198 by Frischknecht et al., in particular FIG. 5 and its description which forms an integral element in the understanding of the horizontally displaceable and height-adjustable casting nozzle 10.

Metal level 52 of the mobile casting channel 32 and metal level 50 of the melt distribution trough 12 are controlled and adjusted with floats or non-contact sensors, not shown for the sake of simplicity. Both processes are known. The signals generated are proportional to the level of the float or the distance between the sensor and the metal surface. These signals are processed and transferred to a processor or computer which triggers the activation of actuator elements to control the metal supply in accordance with the measured metal levels 50, 52. One such actuator element for example is flap 44. On withdrawal of the casting nozzle 10, the metallostatic pressure can be increased by raising the metal level 50 and the outlet opening 20 can be enlarged without further auxiliary means being required.

Figure 4:
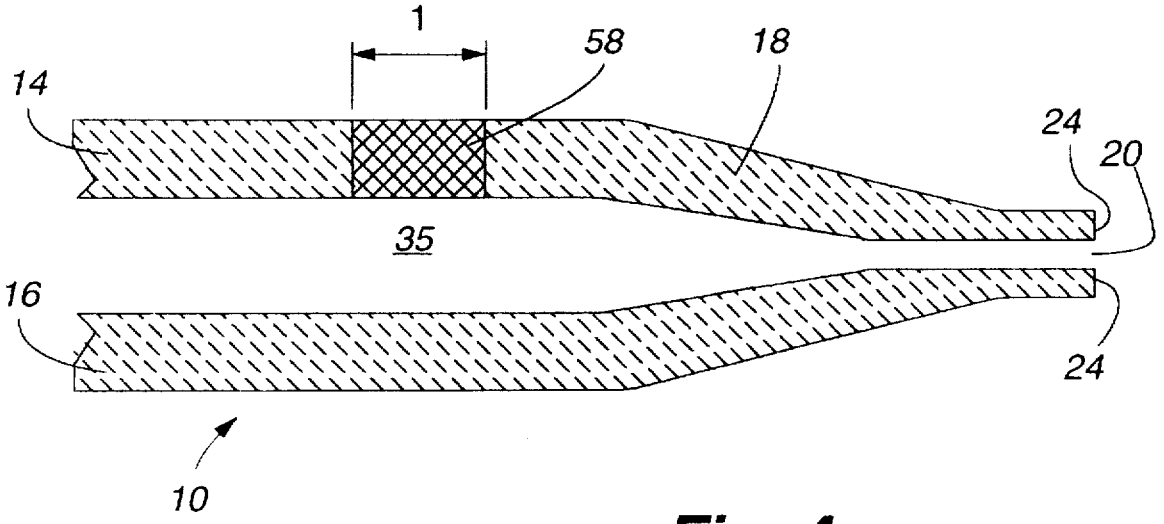

FIG. 4 shows a variant of an upper nozzle element 14 with an adjustable mouthpiece 18. The nozzle elements 14, 16 consist for example of ceramic fibres impregnated with slip, which are dried and baked such that the casting nozzle meets all chemical and physical requirements. In the upper nozzle element 14 over the entire width of the casting nozzle, the ceramic fibres are not impregnated with slip over a length 1 of for example 20 to 30 mm. Thus during the baking they remain flexible and do not become brittle as the remaining part of nozzle element 14. This shaped elastic block allows adjustment of the outlet opening 20 by swivelling the mouthpiece 18 of the upper nozzle element 14.

Because of the high surface tension of the liquid metal 35, this cannot penetrate the ceramic fibres in the area of the elastic block 58.

Figure 5:
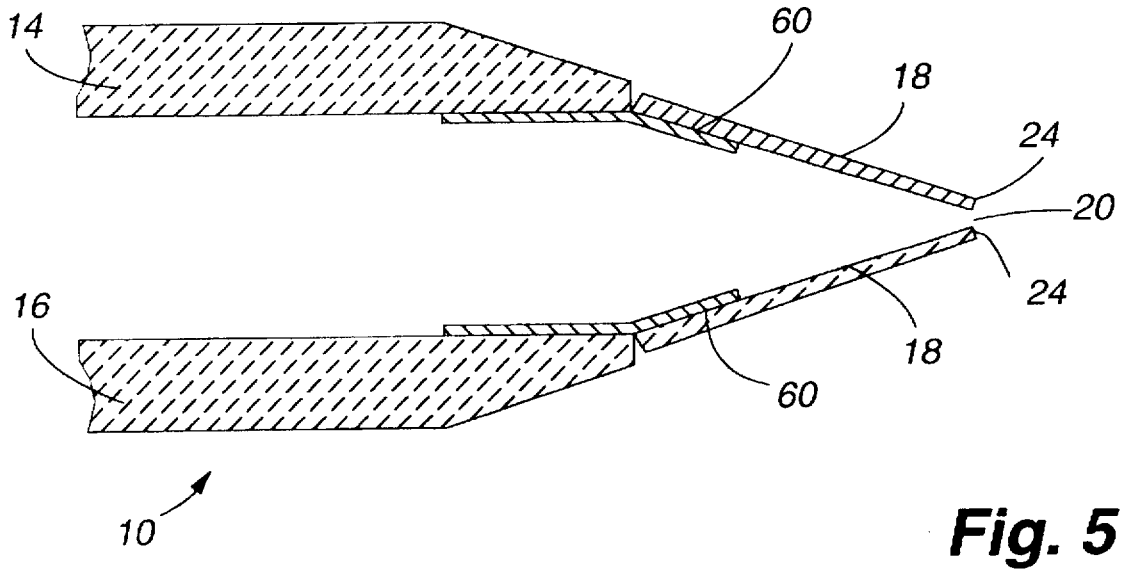

FIG. 5 shows an upper and a lower nozzle element 14, 16 and the corresponding mouthpiece 18 forming nozzle opening 20, which are connected via an internal textile or strip hinge 60. A textile hinge is flexible in relation to bending but does not allow expansion in a longitudinal direction. It consists of temperature- and tension-resistant fibres which do not oxidize, for example Fiberfrax. In particular for casting aluminium or aluminium alloys, a strip hinge made of metal, for example spring steel, can also be used. A textile or strip hinge 60 can be arranged inside or outside a nozzle element.

This figure also shows that a nozzle according to the invention can consist not only of a conventional nozzle form with one or two cut-away mouthpieces but also of simple moulded parts, for example a thicker and a thinner plate of rectangular cross section. The design form in FIG. 5 shows nozzle elements 14, 16 angled in the direction of outlet opening 20, and mouthpiece 18 which contracts linearly over its entire length.

Figure 6:
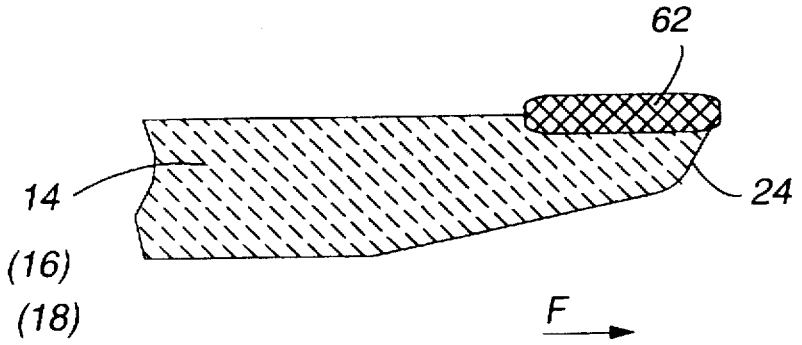

FIG. 6 shows the area of the nozzle lip of an upper nozzle element 14. In the area of the nozzle lips 24 over the entire width of the upper nozzle element are arranged several inserts 62 of a self-lubricating material, in the present case graphite. The inserts 62 stand approximately 0.2 to 0.3 mm from the nozzle lip and can thus avoid any accidental contact of nozzle 10 with a casting roller 26, 28 (FIG. 1, 2) during casting.

Evidently, insert 62 can also be used in mouthpiece 18 and in a lower casting element 16.

Figure 7:
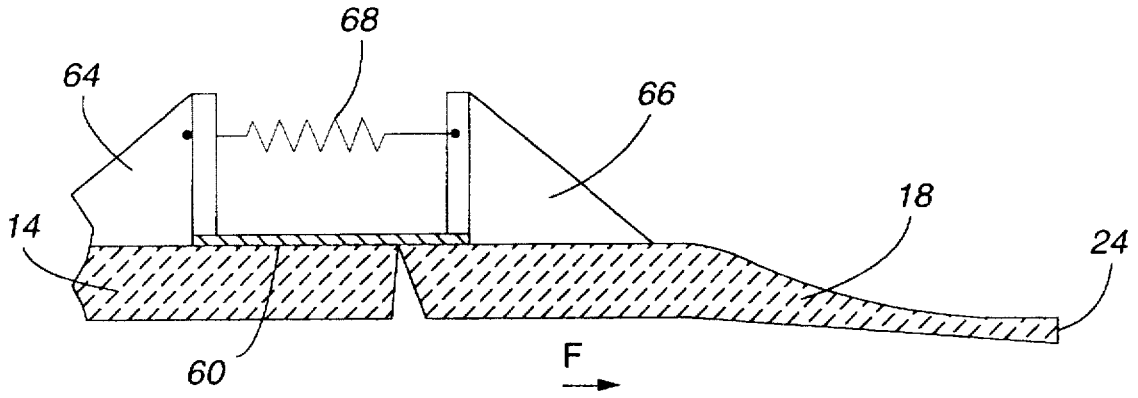
Figure 8:
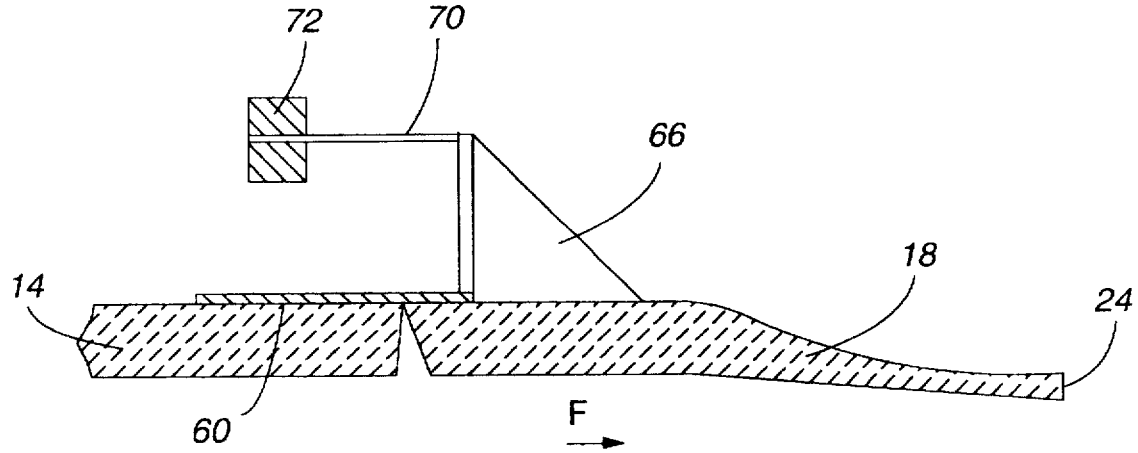

FIGS. 7, 8 show means for adjustment of mouthpiece 18 of an upper nozzle element 14. Evidently the lower nozzle element 16 may have a correspondingly adjustable mouthpiece 18, but this is not usually necessary as the inherent weight of mouthpiece 18 causes an automatic downward swivelling. In all cases, as already stated, the metallostatic pressure can be used instead of or to supplement mechanical means.

In FIG. 7, an angle piece 64, 66 is attached to the mouthpiece 18 and to the upper nozzle element 14 connected with a textile or strip hinge 60, at least two such pieces depending on the width of casting nozzle 10. The angle pieces 64, 66 lying behind each other in the direction of flow F of the liquid metal are connected together via a spring 68. In the starting position S (FIG. 1,2) this is slightly tensioned, and on withdrawal of casting nozzle 10 to the working position W, the mouthpiece 18 is raised according to the casting roller 26.

In the design form in FIG. 8, only the mouthpiece 18 has an angle piece 66. To this is attached a threaded rod 70 running in the direction of flow F of the liquid metal, which carries a counterweight 72 displaceable by turning which corresponds in function to the spring 68 in FIG. 7.

In further variants not shown, forces controllable via cylinders and other rods articulatedly linked to the angle piece 66 can be set and generated by program control using the above pneumatic, hydraulic or electromotor means and thus define an exact path.

All figures are drawn for the horizontal strip casting plant but are also suitable for inclined strip casting angled up or down, FIGS. 3 and 8 only for minor deviations from the horizontal. If FIGS. 1, 2 and 4 to 7 are rotated through 90°, they show vertical strip casting plants.

We claim:

1. A strip casting plant for metals comprising:

a caster comprising rotating dies;

a melt distribution trough; and a casting nozzle for supplying liquid metal to a rolling gap between said rotating dies of said caster, said casting nozzle comprising two nozzle elements and two side limiters which form an outlet opening for said liquid metal;

wherein said casting nozzle is displaceable in the direction of flow of said liquid metal and adjustable perpendicular to the direction of flow;

wherein said nozzle elements are attached to said melt distribution trough; and wherein one or both of said nozzle elements is independently displaceable by rotation around an axis transverse to the direction of flow of said liquid metal through said nozzle.

2. The strip casting plant as claimed in claim 1, wherein at least one nozzle element of said casting nozzle is supported by a nozzle holder mounted on said melt distribution trough.

3. The strip casting plant as claimed in claim 1, wherein at least one nozzle element has an axis parallel to said outlet opening for swivelling of a mouthpiece.

4. The strip casting plant as claimed in claim 2, wherein one the melt distribution trough one nozzle element is arranged on a hinge mounted to swivel about a first axis and a second nozzle element is arranged on a second hinge mounted to swivel about a second axis, wherein said hinges comprise textile hinges.

5. The strip casting plant as claimed in claim 1, wherein said nozzle element comprises a thicker plate rigidly mounted on said melt distribution trough and a thinner mouthpiece plate articulately connected, where both plates are essentially rectangular in cross section.

6. The strip casting plant as claimed in claim 1, said nozzle elements having nozzle lips, wherein said nozzle lips comprise integrated sliding inserts of a self-lubricating material.

7. The strip casting plant as claimed in claim 1, wherein a tension spring is mounted on at least one angle piece of a rotatable mouthpiece of said nozzle element for adjusting the position of said mouthpiece.

8. The strip casting plant as claimed in claim 1, said nozzle element having a swivelable mouthpiece, wherein an adjustment device with servo control acts on said swivelable mouthpiece using an angle piece.

9. A strip casting plant as claimed in claim 5, wherein said plates are bevelled.

10. A strip casting plant as claimed in claim 4, wherein said hinges comprise an elastic block.

11. A strip casting plant as claimed in claim 4, wherein said hinge comprises a strip hinge.

12. A strip casting plant as claimed in claim 6, wherein said material comprises graphite.

13. A strip casting plant as claimed in claim 6, wherein said material comprises hexagonal boron nitride.

14. A process for the operation of a strip casting plant comprising the steps of advancing a casting nozzle with an outlet opening to a start position between rotating dies at the start of a casting operation and withdrawing said nozzle to a work position and expanding said outlet opening of said nozzle according to the position of said rotating dies, said casting nozzle having nozzle elements independently displaceable by rotation around an axis transverse to the direction of flow of liquid metal through said nozzle.

15. The process as claimed in claim 14, wherein during withdrawal of said casting nozzle in a horizontal caster, the metallostatic pressure is increased by raising the level of liquid metal in a melt distribution trough, wherein said melt distribution trough is attached to said casting nozzle.

16. A casting nozzle for supplying liquid metal to a roller gap between rotatable dies of a caster comprising two nozzle elements and two side limiters which form an opening for the passage of said liquid metal, wherein at least one of said nozzle elements is independently displaceable in relation to the other of said nozzle elements by rotation around an axis transverse to the direction of flow of said liquid metal through said nozzle.

17. The casting nozzle as claimed in claim 16, wherein at least one of said nozzle elements is displaceable perpendicular to the direction of flow of said liquid metal through said nozzle and independent from the other nozzle element.

18. The casting nozzle as claimed in claim 16, wherein said axis of rotation comprises a hinge.

19. The casting nozzle as claimed in claim 18, wherein said hinge comprises a strip hinge.

20. The casting nozzle as claimed in claim 18, wherein said hinge comprises spring steel.

21. The casting nozzle as claimed in claim 18, wherein said hinge comprises a section of elastic block of fiber material.

22. The casting nozzle as claimed in claim 18, wherein said hinge comprises tension resistant textile.

23. The casting nozzle as claimed in claim 16, wherein said nozzle elements comprise slide inserts of a self-lubricating material.

24. A casting nozzle as claimed in claim 23, wherein said self-lubricating material comprises graphite.

25. The casting nozzle as claimed in claim 23, wherein said self-lubricating material comprises hexagonal boron nitride.

26. The casting nozzle as claimed in claim 16, wherein said nozzle elements are attached to a melt distribution trough using a swivelling nozzle holder.

27. The casting nozzle as claimed in claim 16, wherein said nozzle elements are adjusted to within less than about 0.5 mm from said rotatable dies.

28. The casting nozzle as claimed in claim 16, comprising a means for adjusting the position of said nozzle element.

29. The casting nozzle as claimed in claim 28, wherein said means for adjusting comprises forces generated by pneumatic means, hydraulic means or electric means.

30. The casting nozzle as claimed in claim 28, wherein said means for adjusting comprises a tension spring.

31. The casting nozzle as claimed in claim 28, wherein said means for adjusting comprises a counterweight.

32. The casting nozzle as claimed in claim 28, wherein said means for adjusting comprises adjusting the metallostatic pressure created by said liquid metal.

33. A method for casting liquid metal comprising the steps of:

(a) providing liquid metal to a melt distribution trough;

(b) placing a casting nozzle into a roller gap between rotatable dies of a continuous caster to a first position, wherein said casting nozzle comprises two nozzle elements, and at least one of said nozzle elements is independently displaceable in relation to the other of said nozzle elements by rotation around an axis transverse to the direction of flow of said liquid metal through said nozzle;

(c) supplying liquid metal to said rotatable dies through said casting nozzle;

(d) withdrawing said casting nozzle from said roller gap to a second position; and (e) adjusting the position of at least one nozzle element in relation to the position of said rotatable dies.

34. The method as claimed in claim 33, wherein said nozzle element is adjustable to within less than about 0.5 millimeters from the surface of said rotatable dies.

35. The method as claimed in claim 33, wherein said nozzle element is adjustable to within less than about 0.2 millimeters from the surface of said rotatable dies.

36. The method as claimed in claim 33, wherein said position of said nozzle element in relation to said roller gap is automatically controlled.

37. The method as claimed in claim 33, wherein the rotation of said nozzle element is automatically controlled.

* * * * *